United States Patent [19]

Belkin

[11] 4,214,320

[45] Jul. 29, 1980

[54] SURGICAL GOWN AND METHOD OF DONNING GOWN

[75] Inventor: Nathan L. Belkin, Huntington, N.Y.

[73] Assignee: Superior Surgical Mfg. Co., Inc., Seminole, Fla.

[21] Appl. No.: 2,947

[22] Filed: Jan. 11, 1979

[51] Int. Cl.[2] ..... A41D 13/00

[52] U.S. Cl. ..... 2/114; 2/DIG. 7

[58] Field of Search ..... 2/114, 48, 74, 105, 2/DIG. 7

[56] References Cited

U.S. PATENT DOCUMENTS

| | | | |
|---|---|---|---|
| 2,818,573 | 1/1958 | O'Donnell | 2/114 |
| 3,155,984 | 11/1964 | Derrick | 2/114 |
| 3,359,569 | 12/1967 | Rotanz et al. | 2/114 |
| 3,803,640 | 4/1974 | Ericson | 2/114 |
| 3,868,728 | 3/1975 | Krzewinski | 2/114 |
| 3,935,596 | 2/1976 | Allen et al. | 2/114 |
| 4,000,521 | 1/1977 | Zoephel et al. | 2/114 |

FOREIGN PATENT DOCUMENTS

| | | | |
|---|---|---|---|
| 382129 | 1/1908 | France | 2/114 |

*Primary Examiner*—Louis Rimrodt
*Attorney, Agent, or Firm*—Weingram & Klauber

[57] ABSTRACT

A surgical gown includes three arm holes, two of which have long covered sleeves. The third arm hole is a large opening in an extended side panel having a shoulder band along one edge to permit the length of the upper arm between the shoulder and elbow to pass through. A pull tab or donning tab is secured to the band, and is intended to be manipulated by an assistant during the donning of the gown. In the closed position, the extended panel completely covers the back and overlaps the other side and a front portion of the gown, with the band secured around the shoulder and sleeve. The front panel and lower sleeves are formed of material having a low bacteria and fluid permeability to avoid possible contamination. The pull tab may include a test pattern which serves as an indicator of sterility when the gown is sterilized before use.

The sterile surgical gown is donned by completely wrapping it around the wearer to provide a secure enclosure which requires no fasteners or ties. Initially the extended side panel is folded back over the front of the gown with a sleeve extending through the third arm hole leaving the back of the gown open. The wearer of the gown first places his arms into the sleeves from the open rear of the gown. An assistant holds the donning tab to guide the extended side panel and band off the sleeved arm extending through the third arm hole, then around the back of the wearer and over the sleeved arm at the other side.

14 Claims, 6 Drawing Figures

SURGICAL GOWN AND METHOD OF DONNING GOWN

BACKGROUND OF THE INVENTION

1. FIELD OF THE INVENTION

The present invention relates to surgical gowns and particularly to a gown which provides a complete secure sterile enclosure secured without ties.

A method is provided for donning the gown to insure sterility is preserved.

2. STATEMENT OF PRIOR ART

Under existing methods, after use, surgical gowns are folded and packaged for sterilization so they can be handled without destroying the sterility of the gown. When ready for further use, after sterilization, operating room attendants assist the surgeons in donning the sterile gowns to avoid contamination of the gown from areas that are to be out of the field of contact with the patient. Present gowns used by surgeons generally do not completely enclose the body and have ties of fasteners in the back which require additional personnel to secure in a sterile manner. Often these ties and/or the gown must be manipulated with forcepts or surgical clamps to avoid touching the gown and thereby compromising its sterile condition. In addition, the ties often loosen to expose the back of the body.

One type of medical garment which does not require fasteners, is an examination gown, such as shown in U.S. Pat. No. 3,155,984, issued Nov. 10, 1964. This gown is completely wrapped around the body and includes an overlapping portion having a wide arm hole and shoulder strap. However, all of the arm holes are open, with no long covered sleeves, and there is no provision for use in a sterile manner, as required for surgery.

A known related type of garment having a non-medical use is shown in French Pat. No. 382129, issued Nov. 30, 1907. In this case, a tunic used by military personnel covers only the upper portions of the body and includes two long covered sleeves in two different side panels, and a front panel with a small arm hole in a side extension. The garment is wrapped around the front and secured by buttons.

Another non-sterile examination gown, shown in U.S. Pat. No. 2,818,573, issued Jan. 7, 1958, includes two overlapping folded sections having two side openings for arms, and lower front and back openings. A tape or tie can be used to maintain the front and back openings closed when desired.

None of these prior art garments, however, provide a complete sterile enclosure for use in surgery which can be donned with minimum assistance while being secured without fasteners or ties.

SUMMARY OF THE INVENTION

To overcome these problems, the present invention provides a unique surgical gown having two full length covered sleeves to receive two arms and an extended side panel having another arm hole which includes an enlarged opening and shoulder strap. The extended side panel is wrapped around the back so that the strap fits over and rests on the shoulder of the sleeve on the opposite side and the arm extends through the opening. The side panel also overlaps a portion of the front panel. A donning tab secured along the shoulder band is used by an assistant to guide the side panel around the body. The lower sleeves and front panel from the chest down may be made of a material having low permeability for bacteria and liquids. The gown may be sterilized by autoclaving. The donning tab may also includes an autoclave test pattern which serves as an indicator of sterility.

It is therefore an object of the present invention to provide a sterile surgical gown which can readily be wrapped completely around the wearer and can be secured without fasteners or ties.

Yet another object of the present invention is to provide a sterile surgical gown which will not loosen or open during normal wearing.

Still another object of the present invention is to provide a sterile surgical gown which does not require the use of special impliments to manipulate the gown during donning to preserve the sterile condition of the gown.

A further object of the present invention is to provide a sterile wrap-around surgical gown having portions made of a material which is resistant to the permeation of bacteria and fluids.

Another object of the invention is to provide a surgical gown with an extended side panel having a donning tab which permits an assistant to guide and secure the gown in a sterile manner.

A further object of the invention is to provide a donning tab for a surgical gown which also serves as an indicator of sterility.

Yet another object of the present invention is to provide a sterile surgical gown which has an indicator device which is relatively tamper proof and accident proof to accurately indicate the sterility of the gown.

Still another object of the present invention is to provide a sterile surgical gown which has an indicating device which cannot be accidentally reused after donning of the gown.

Yet another object of the present invention is to provide a method for donning a sterile surgical gown which enables the gown to be worn without being tied around the body of the wearer.

Still another object of the present invention is to provide a method for donning a sterile surgical gown which does not require the use of special impliments to manipulate the gown during donning.

A further object of the present invention is to provide a method for donning a sterile surgical gown which reduces the chance of contaminating the gown during the donning process.

Yet another object of the present invention is to provide a method for donning a sterile surgical gown which is relatively easy and quick to perform.

Other objects and advantages will become apparent from the following description taken in conjunction with the accompanying drawings.

DESCRIPTION OF THE PREFERRED EMBODIMENT

Figure 1:
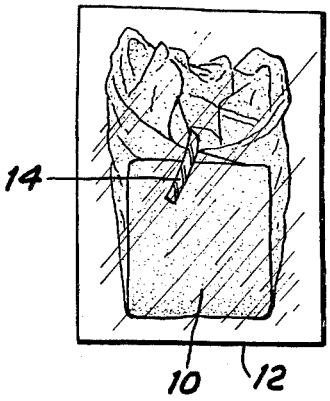
FIG. 1 is a plan view of a surgical gown folded and enclosed within a plastic bag after sterilization.
Figure 2:
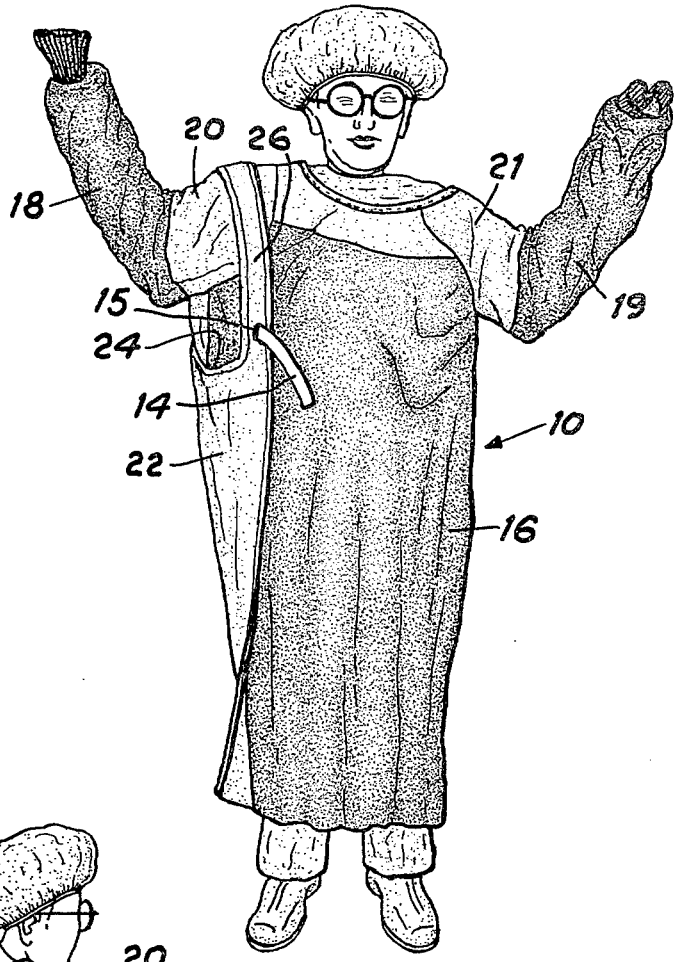
FIG. 2 is a front view of the surgical gown of the present invention as it is being donned in an initial position.

As shown in FIG. 1, the surgical gown 10 is initially laundered after use and then enclosed within an autoclavable package 12 and subjected to sufficient heat for a predetermined length of time to provide sterilization. A pull tab or donning tab 14 secured to the gown includes an autoclave test pattern which becomes visible to indicate when sterilization is completed. When the gown is required for surgery, it is removed from the container, unfolded, and an operating room assistant helps the surgeon or other wearer don the gown in an initial position over the arms, as shown in FIG. 2.

The main front panel 16, from an area above the chest to the bottom edge below the knees, and the lower arm sections 18, 19 of sleeves 20, 21, are made of material having low permeability to bacteria and fluids to prevent penetration of fluids and bacteria during surgery. The arms are inserted through two small arm holes into the two long covered sleeves 20, 21.

An extended side panel 22 secured along one edge of front panel 16 includes a large arm hole 24 and shoulder band 26 enclosing the outer perimeter of the opening. The shoulder strap initially rests over the shoulder on one side with the arm extending through the large arm hole and is conveniently folded in this position together with the side panel for packaging sterilization.

The tab 14, preferably of a suitable paper composition is attached to a lower portion of the shoulder band 26 and fits through a small finished or reinforced slot 15 in the band. The tab may also be detachably secured to the band and may be discarded after use. For example the band may have an adhesive coating on a portion of one surface so that one end can be passed through slot 15 in band 14 and then looped around to contact the adhesive coating.

Additionally the tab may be coated with an indicating material which is steam and/or temperature sensitive so that the coating on the tab will indicate when the gown has been properly autoclaved to insure sterility.

Figure 4:
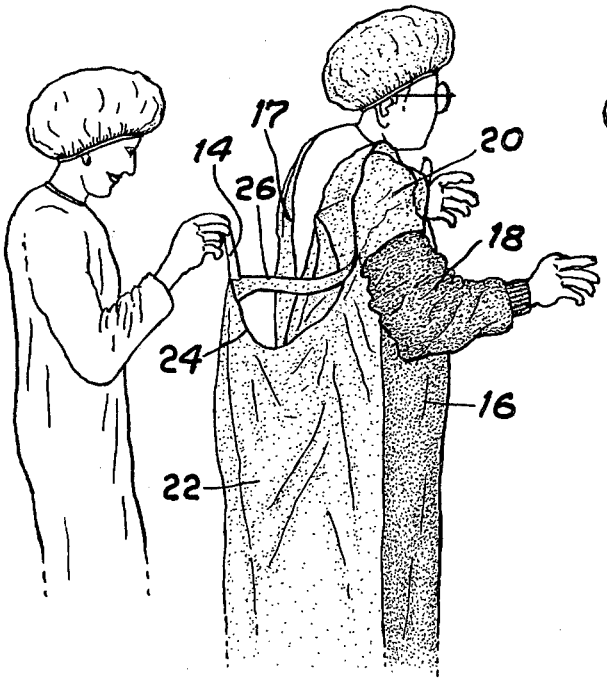
FIG. 4 is a partial side and back view showing the assistant guiding the gown in an intermediate position around the back of the wearer.
Figure 3:
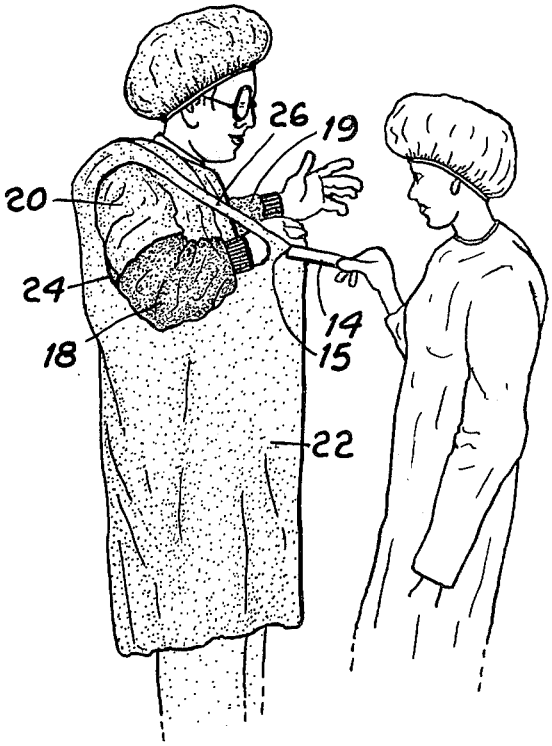
FIG. 3 is a side view of the surgical gown showing an assistant pulling a tab and shoulder strap of an extended side panel over one arm of the wearer.
Figure 5:
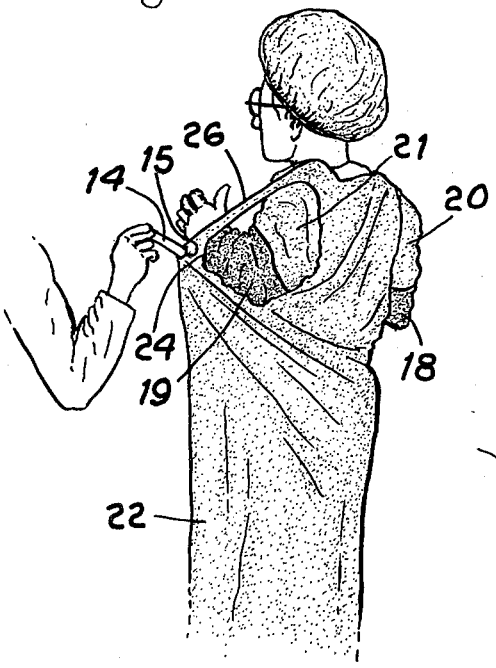
FIG. 5 is a view of a further position of the gown showing the assistant pulling the strap over the other arm of the wearer.

The surgeon must avoid touching areas of the garment to maintain its sterility. Therefore when donning the gown, the assistant holds the pull tab 14, as shown in FIG. 3, so the surgeon can slip his arm, bent at the elbow, forward through the large arm hole 24 and strap 26. The extended side panel 22 and strap are then removed from the shoulder and draped around the back by the assistant holding the tab 14, as shown in FIG. 4. The panel 22 is pulled further to cover the back, as in FIG. 5, with the surgeon then slipping the opposite arm and bent elbow through arm hole 24 and strap 26.

Figure 6:
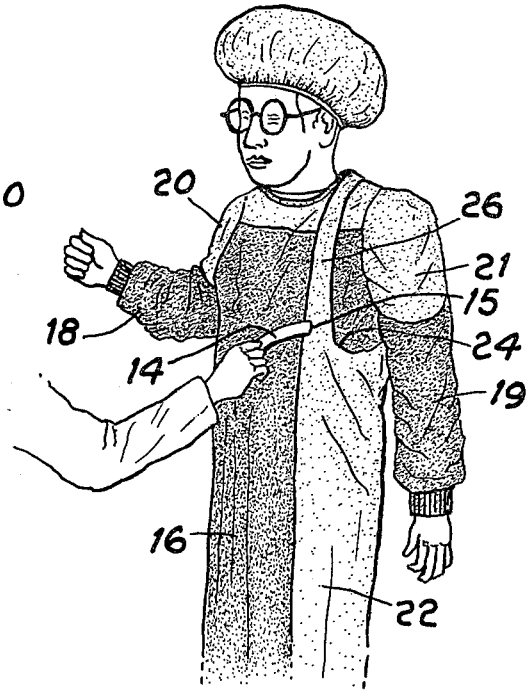
FIG. 6 is a partial front and side view of the gown in a final closed position with the strap and extended panel draped over the shoulder of the other arm.

In the final closed position, as shown in FIG. 6, the panel 22 also overlaps a small panel 17 on the opposite side and a portion of the front panel, with the shoulder strap draped over the upper arm and shoulder of sleeve 21 in a secure position that cannot open or loosen during use. After the gown is in the final position, the assistant helps the surgeon into a pair of surgical gloves which fit over the hands and over the narrow closely fitting wrist bands at the lower ends of the sleeves.

When the gown is in the secure position, the assistant, still holding the donning tab, can rip the tab off the gown. Therefore any undonned gown without a tab showing proper autoclaving will immediately be considered as nonsterile and in need of a new indicating tag and subsequent sterilization.

The gown when donned completely encloses the body of the wearer and maintains itself in a closed position without requiring any ties or fasteners.

The procedure for donning the gown permits more efficient use of operating room personnel. The use of the pull tab aids in preventing contamination.

While only a single embodiment has been illustrated and described, many variations may be made in the particular design and configuration without departing from the scope of the invention as set forth in the appended claims.

What is claimed is:

1. A surgical gown comprising:

first and second elongated sleeves for receiving the arms of the wearer;

a front panel extending lengthwise from an area above the chest to an area below the knees of the wearer and crosswise between the two sleeves;

an extended side panel adjoining said front panel adjacent a first sleeve and along the length of one side, said side panel including an enlarged opening in the upper end having a shoulder band enclosing the outer perimeter of said opening, said opening being sufficiently large to receive the length of the upper arm between the shoulder and elbow of the wearer, said side panel being of sufficient width to extend completely around the back and overlap a portion of the front panel to enclose the body of the wearer;

said shoulder band being disposed over the shoulder on the opposite side in a closed position and said second sleeve extending throught said opening; and said shoulder band coacting with the shoulder and said second sleeve on the opposite side to position the hanging lower portion of the elongated panel edge in overlapping relation to the front panel of the gown to maintain the gown in a closed position.

2. The surgical gown of claim 1 wherein said front panel and lower sleeves including areas of material having low permeability to liquid and bacteria.

3. The surgical gown of claim 2 wherein said means includes a detachable donning tab secured to said extended side panel adjacent said shoulder band.

4. The surgical gown of claim 1 including means along the outer edge of said side panel adjacent said shoulder band for pulling said extended side panel around the back and opposite side of the wearer.

5. The surgical gown of claim 4 wherein said means includes a small opening through the lower end of said shoulder band to receive and secure said donning tab.

6. The surgical gown of claim 4 wherein said donning tab includes indicia for indicating a condition of sterility upon subjecting said gown and tab to sufficient heat for a predetermined time to cause sterilization.

7. The surgical gown of claim 6 wherein said extended side panel is folded in an initial open position, said shoulder band being folded toward said front panel and being draped over said first sleeve along said one side, said first sleeve extending through said enlarged opening.

8. The surgical gown of claim 7 wherein each said sleeve includes a narrow closely fitting wrist band at the lower end thereof.

9. The surgical gown of claim 1 wherein said extended side panel is folded in an initial open position, said shoulder band being folded toward said front panel and being draped over said first sleeve along said one side, said first sleeve extending through said enlarged opening.

10. The surgical gown of claim 1 wherein each said sleeve includes a narrow closely fitting wrist band at the lower end thereof.

11. A method of sterilely donning a surgical gown comprising the steps of:

the wearer placing each arm into a separate sleeve of the gown to cover the wearers chest with the gown;

unfolding an extended side panel of the gown over a first arm extending through a third armhole in the side panel;

guiding the extended side panel around the back of the wearer to enclose the back of the wearer; and guiding the extended side panel to pass the third armhole over the second sleeved arm of the wearer to support and position the side panel from the wearers shoulder and thereby wrap the gown around the wearer in secured position.

12. The method of claim 11 wherein the wearer places each arm into a separate sleeve of the gown from a position behind the front of the gown.

13. The method of claim 11 further comprising the step of grasping a tab extending from the extended side panel to assist in guiding of the extended side panel.

14. The method of claim 13 further comprising the step of tearing the tab from the gown after the extended side panel has been positioned to be supported by the wearers other shoulder.

* * * * *